US007070435B2

(12) United States Patent
Ramsay

(10) Patent No.: US 7,070,435 B2
(45) Date of Patent: Jul. 4, 2006

(54) ELECTRICAL SAFETY PLUG AND SOCKET

(76) Inventor: George Stephen Ramsay, 127 Queens Parade, Newport Beach NSW 2106 (AU)

( * ) Notice: Subject to any disclaimer, the term of this patent is extended or adjusted under 35 U.S.C. 154(b) by 0 days.

(21) Appl. No.: 10/534,270

(22) PCT Filed: Nov. 6, 2003

(86) PCT No.: PCT/AU03/01469

§ 371 (c)(1),
(2), (4) Date: May 6, 2005

(87) PCT Pub. No.: WO2004/042879

PCT Pub. Date: May 21, 2004

(65) Prior Publication Data

US 2006/0019524 A1 Jan. 26, 2006

(30) Foreign Application Priority Data

Nov. 6, 2002 (AU) ..... 2002952499
Aug. 8, 2003 (AU) ..... 2003904226

(51) Int. Cl.
*H01R 13/625* (2006.01)

(52) U.S. Cl. ..... 439/342

(58) Field of Classification Search ..... 439/342, 439/218, 352, 188, 668, 103, 104, 13, 21
See application file for complete search history.

(56) References Cited

U.S. PATENT DOCUMENTS 4,420,216 A * 12/1983 Motoyama et al. ..... 439/188
4,556,475 A * 12/1985 Bayha et al. ..... 204/427
5,261,838 A * 11/1993 Fujie ..... 439/668
5,964,623 A * 10/1999 Maher et al. ..... 439/668
6,109,797 A * 8/2000 Nagura et al. ..... 385/88
6,135,798 A * 10/2000 Saruta et al. ..... 439/259
6,149,469 A * 11/2000 Kim ..... 439/668
6,835,085 B1 * 12/2004 Sone et al. ..... 439/352
D507,532 S * 7/2005 Kajiwara et al. ..... D13/144
2005/0286836 A1 * 12/2005 Feinweber et al. ..... 385/76
2006/0019524 A1 * 1/2006 Ramsay ..... 439/342

* cited by examiner

*Primary Examiner*—Alexander Gilman
(74) *Attorney, Agent, or Firm*—Brooks Kushman P.C.

(57) ABSTRACT

An electrical plug (1) comprising a prong (4) extending from a body (3), said prong having a tip segment (5) at its free end, a base segment (7) at its other end, and an intermediate segment (6) therebetween, each segment being insulated from each other, said tip segment and said intermediate segment adapted for carrying current, said plug having wire connection means extending into said prong, said plug adapted to be inserted into a socket (2) and then subsequently rotated such that at least a portion of said intermediate segment engages with a first current carrying contact member housed within the socket, and wherein said intermediate segment comprises at least two equally spaced apart wings (8) each of which is adapted to carry current and at least one of the wings is adapted to contact the first current carrying contact member.

17 Claims, 4 Drawing Sheets

ELECTRICAL SAFETY PLUG AND SOCKET

TECHNICAL FIELD

The present invention relates to an electrical plug and socket that may be used for domestic, industrial or any other use.

BACKGROUND

In Australia and in many other countries existing two and three pin electrical plugs become alive when partially inserted into a power supply socket and such terminals are visually exposed and accessible or vulnerable to contact by foreign objects. There have been proposed a number of prior art devices to make such plugs and sockets safer, however, in most instances such safety devices are usually related to minor modifications or additions to the conventional plug/socket pin arrangements.

The present invention seeks to provide an electrical plug that does not suffer from the disadvantages of the above-mentioned conventional plug/socket arrangements.

SUMMARY OF INVENTION

According to a first aspect the present invention consists in an electrical plug comprising a prong extending from a body, said prong having a tip segment at its free end, a base segment at its other end and an intermediate segment therebetween, each segment being insulated from each other, said tip segment and said intermediate segment adapted for carrying current, said plug having wire connection means extending into said prong, said plug adapted to be inserted into a socket and then subsequently rotated such that at least a portion of said intermediate segment engages with a first current carrying contact member housed within said socket, and wherein said intermediate segment comprises at least two equally spaced apart wings each of which is adapted to carry current and at least one of said wings is adapted to contact said first current carrying contact member.

Preferably said tip segment engages with a second current carrying contact member housed within said socket.

Preferably at least a portion of said tip member comprises at least two spaced apart wings each of which is adapted to carry current and at least one of said wings is adapted to contact said second current carrying contact member.

Preferably said at least two equally spaced apart wings is three equally spaced apart wings.

Preferably at least a portion of said tip member comprises at least three spaced apart wings each of which is adapted to carry current and at least one of said wings are adapted to contact said second current carrying contact member.

Preferably the aperture of said socket is complementary shaped to receive said prong.

Preferably said prong has a base member adapted to be connected to earth.

Preferably said base member engages with an earth contact member that shrouds the aperture of said socket.

Preferably said intermediate segment is adapted to carry the active current and said tip segment adapted to carry the neutral current.

Preferably said intermediate segment is adapted to carry the neutral current and said tip segment adapted to carry the active current.

Preferably said intermediate segment has three separate current carrying portions, a first portion, a second portion and a third portion, each portion is insulated from each other and the first portion is adapted to engage with said first current carrying contact member.

Preferably said socket comprises a clutch-release mechanism that allows said prong to rotate and disengage from said socket when sufficient force is applied to the plug in a direction substantially opposite to the entry of said prong.

Preferably in one embodiment said at least two equally spaced apart wings each have a kinked portion thereon.

BEST MODE OF CARRYING OUT INVENTION

Figure 1:
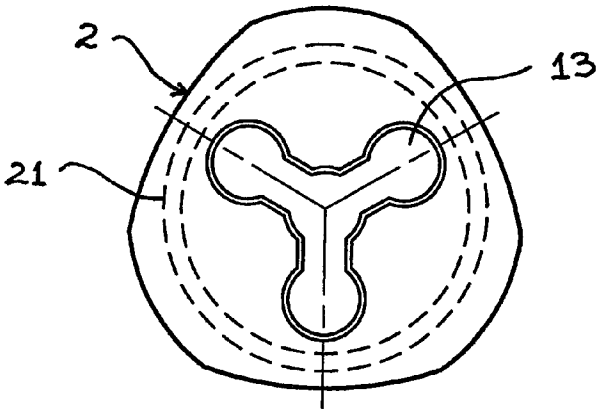
FIG. 1 is an end elevation of a socket for use with a first embodiment of a plug in accordance with the present invention.

FIGS. 1–4 depict the first embodiment of an electrical plug 1 and socket 2. Plug 1 has a body 3 of insulating material (plastic, rubber, etc.). Extending from an end of body 3 is a prong 4. The prong 4 has a tip segment 5, an intermediate segment 6 and a base segment 7. The intermediate segment 6 and a portion 5*a* of the tip segment 5 have an elongated "tri-wing" configuration ie. having three equally spaced apart wings 8. The tip segment 5, intermediate segment 6 and base segment 7 are each electrically conductive and insulated from each other. A lead 9 extending from body 3 carries an active wire 10, neutral wire 11 and an earth wire 12, all of which extend through the core of prong 4. Active wire 10 is electrically connected to intermediate segment 6, neutral wire 11 is electrically connected to tip segment 5, and earth wire 12 is electrically connected to base segment 7.

Figure 2:
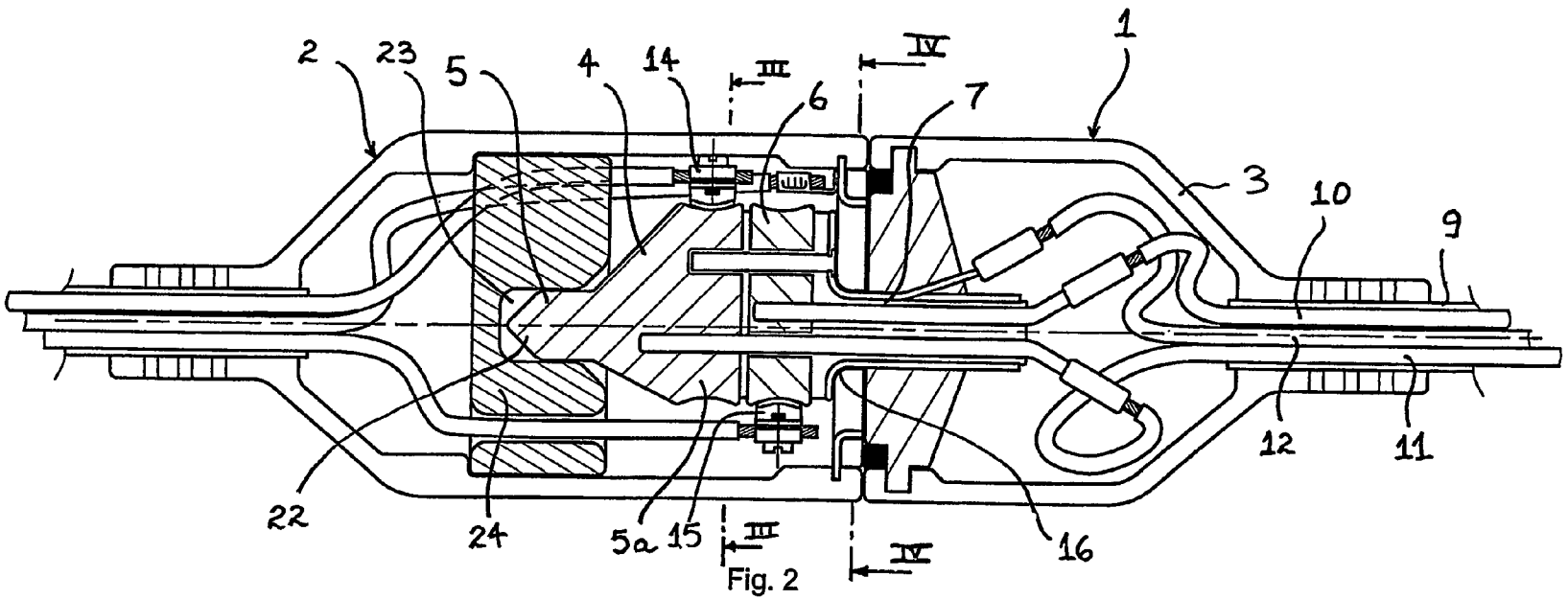
FIG. 2 is a cross-sectional view of a first embodiment of plug connected to the socket shown in FIG. 1.

As shown in FIG. 2, socket 2 has a tri-wing shaped aperture adapted to receive prong 4 of plug 1. The socket 2 has a region 21 as shown in FIG. 1, for engaging a seal ring (not shown) on plug 1 affecting a dust and moisture seal when plug 1 is inserted thereinto.

In use, prong 4 is inserted into aperture 13 within socket 2, and tip 22 of tip segment 5 sits in cavity 23 of end abutment 24. Prong 4, is orientated at entry into aperture 13 as shown by the dotted lines 17 in FIG. 3. Upon a 60° rotation of prong 4 (see arrow R) the portion 5*a* of tip segment 5 which has a tri-wing configuration, engages with the neutral current carrying contact member 14, and the intermediate segment 6 which is electrically connected to active wire 10 engages with the active current contact member 15. Earth wire 12 which is connected to base segment 7 connects with the earth contact member 16 which is mounted about the periphery of socket aperture 13. As a result of the "neck like" portion of base segment 7 extending from body 3, the plug 1, can only be rotated to achieve electrical connection when plug 1 has been fully or near fully inserted into socket 2.

Figure 4:
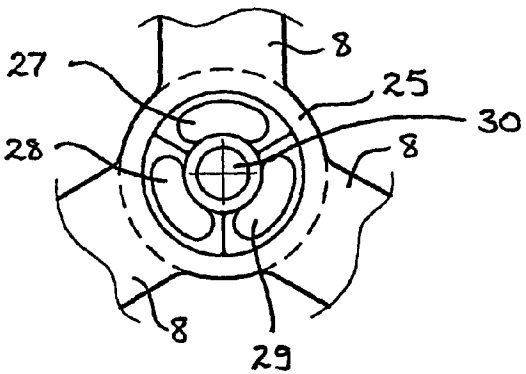
FIG. 4 is an enlarged partial sectional view through IV—IV of the plug shown in FIG. 2.
Figure 3:
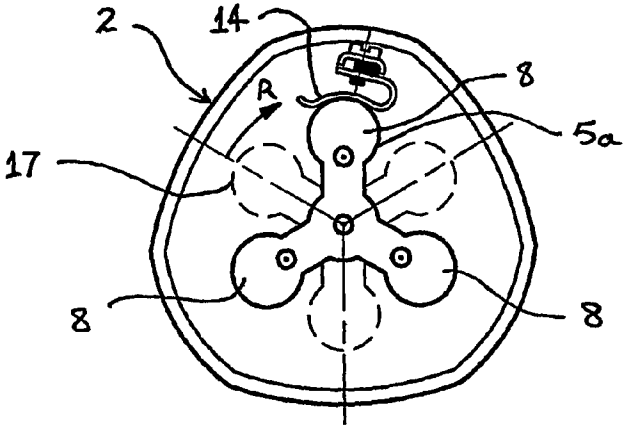
FIG. 3 is a schematic sectional view through III—III of the plug and socket shown in FIG. 2.
Figure 5:
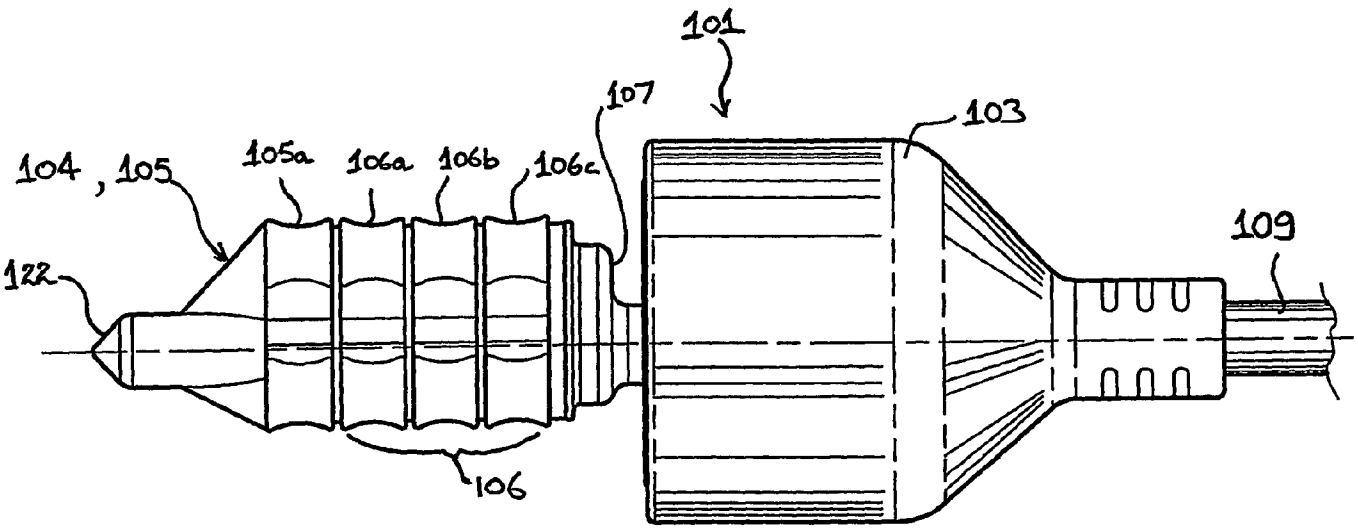
FIG. 5 is an elevation of a second embodiment of a plug in accordance with the present invention.

FIG. 4 depicts an enlarged section of the core 25 of prong 4, and cavities therein 27,28,29 and 30 being independently insulated, through which the wires 10,11 and 12 may extend.

FIGS. 5–8 show a second embodiment of an electrical plug 101 and socket 102. In a similar manner to plug 1 of the first embodiment, plug 101 has a body 103 of insulating material. Extending from an end of body 103 is a prong 104. The prong 104 has a tip segment 105, and intermediate segment 106 and a base segment 107. In a similar fashion to the first embodiment, the intermediate segment 106 and a portion 105*a* of tip segment 105 have an elongated tri-wing configuration ie. having three equally spaced apart wings 108. The tip segment 105, intermediate segment 106 and base segment 107 are each electrically conductive and insulated from each other. A lead 109 extending from body 103 carries an active wire 110, neutral 111 and an earth wire 112 all of which extend through the core of prong 104. Active wire 110 is electrically connected to intermediate segment 106, neutral wire 111 is electrically connected to tip segment 105, and earth wire 112 is electrically connected to base segment 107.

The main difference between this second embodiment of electrical plug 101 and that of the first embodiment depicting plug 1, is that in this embodiment the intermediate segment 106 has three separate axially spaced apart portions 106*a*, 106*b* and 106*c*, which are electrically insulated from each other.

In use prong 104 is inserted into the aperture of socket 102 and tip 122 at the free end of tip segment 105 seats in the cavity 123 of end abutment 124. Prong 104 is oriented at entry as shown by the dotted lines 117 in FIG. 7. Upon a 60° rotation of prong 104 (see arrow $R_1$), the portion 105*a* of tip segment 105 having a tri-wing configuration engages with the neutral current carrying contact member 114, and the intermediate segment 106 which is electrically connected to active wire 110 engages with the active current contact 115 within socket 102. The earth wire 112 which is connected to base segment 107 connects with the earth contact member 116 which is mounted about the periphery of the aperture of socket 102. As a result of the "neck like" portion of base segment 107 extending from body 103, the plug 101, can only be rotated to achieve electrical connection when plug 101 has been fully or near fully inserted into socket 102.

The three intermediate segment portions 106*a*, 106*b* and 106*c* could be used for a three-phase power supply, with each portion able to carry one of the phases. Alternatively, a plug and socket arrangement of this second embodiment could be used in a single phase supply where the segment 106*a* carries the active supply, whilst portions 106*b* and 106*c* could be used as a switching arrangement for use in safety switching and the like and could for example be used on the power tool and safety trigger described in the applicant's co-pending Australian provisional patent application no. 2002953412 entitled "Electrical Device with a Safety Switch" filed 18 Dec. 2002.

Figure 6:
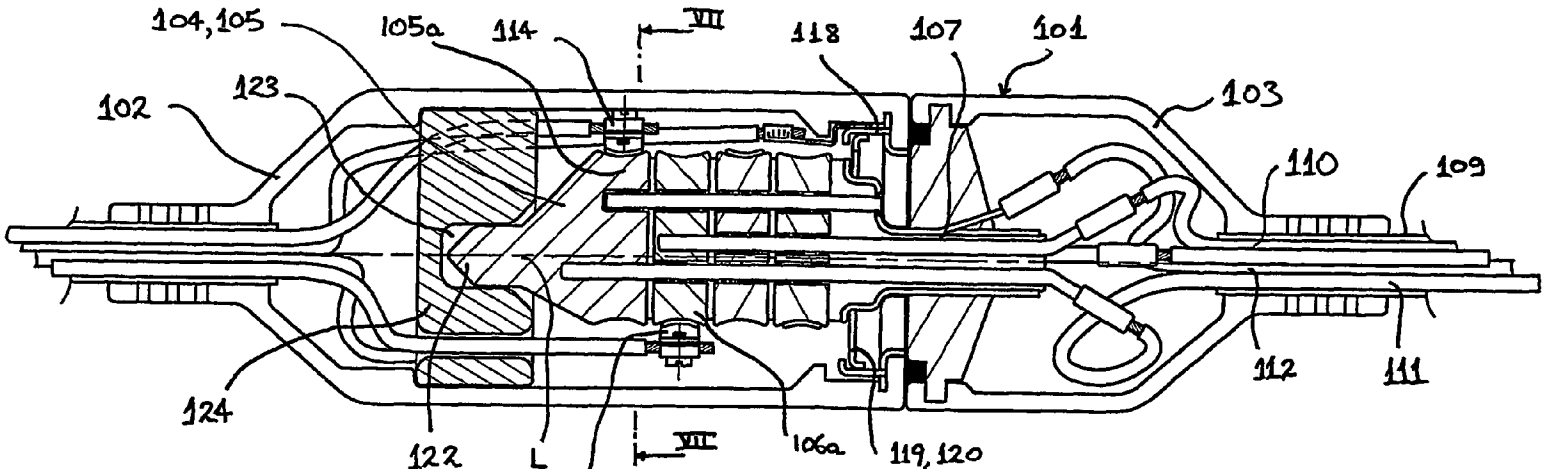
FIG. 6 is a cross-sectional view of the second embodiment of plug shown in FIG. 5, connected to a socket.

In the sectional view of FIG. 6, the socket 102 of the second embodiment also has a clutch-release mechanism 118 that allows prong 104 and therefore plug 101 to rotate and disengage from socket 102, when sufficient force is applied to plug 101 in a direction substantially opposite to the entry of prong 104. Clutch-release mechanism 118 comprises a drive plate 119 and pressure plate 120. The drive plate 119 is journalled to the prong 104 for rotation therewith. When prong 104 is operably connected to socket 102, drive plate 119 it is held in place in "detent engagement" by a pressure plate 120 against a spring (not shown) on drive plate 119 acting about the longitudinal axis L of prong 104. If sufficient force is applied to the body 103 of plug 101 in a direction substantially opposite to the entry of the prong 104, the pressure plate 120 will disengage from drive plate 119, thereby allowing drive plate 119 to rotate through 60° as a result of the spring force. As drive plate 119 rotates so does prong 104, thereby disengaging it from the socket contact members 114,115 and allows prong 104 to be withdrawn from the socket 102.

Plug 101 has a seal ring 151 for affecting a dust and moisture seal when plug 101 is inserted into socket 102.

Advantages of the above mentioned embodiments are as follows. Firstly, as the prongs 4 and 104 have a tri-wing configuration in the form of three spaced apart wings 8,108 and their electrical contacts are spaced apart as segments 5,6,7 and 105,106,107, the prong 4 or 104 can be inserted into its respective socket 2 or 102 in any one of three orientations, rather than having to axially align the pins of a conventional plug to its correct single entry orientation, thereby making the present embodiments easier to insert.

Secondly, the plug 1 or 101 may then be rotated either clockwise or anti-clockwise to make the electrical connection. Plugs 1 and 101 do not electrically connect within respective sockets 2 and 102, until they are fully inserted and concealed prior to rotation, thereby incorporating another level of safety, whether the socket forms the female end of a power lead or a part of a general-purpose power outlet. In a configuration where socket 2 or 102 forms part of a general-purpose power outlet, it may be used without a power switch, as the electrical connection does not take place without rotation of the plug relative to the socket. Notwithstanding this, a separate power switch may be used for additional safety.

Thirdly, as socket 2 or 102 has its earth contact member 16 or 116 respectively mounted about the periphery of socket aperture 13 or 113 thereby protecting the entry point, it would be difficult for a child to receive an electric shock or possible electrocution by placing foreign objects into socket 2 or 102.

Fourthly, the plug and sockets of the abovementioned embodiments do not readily come apart as with conventional plugs as they must be rotated prior to withdrawal. In the second embodiment where a clutch release mechanism is fitted as shown in FIG. 6, the plug and socket has an emergency tension release function.

Fifthly, whilst the first embodiment of the present invention may be used with a single-phase supply, the second embodiment of the present invention may be used for two-phase or three-phase supply or safety switching of electrical devices.

Sixthly, the plug and socket is provide with a seal for preventing ingress of moisture and dust, when the plug is fitted to the socket.

It should be understood that in other not shown embodiments, the plug and socket arrangement may be used for application where no earth is required.

It should also be noted that whilst the abovementioned first embodiment depicts the active wire 10 electrically connected to intermediate segment 6, and neutral wire 11 is electrically connected to tip segment 5, they could be swapped around such that the neutral wire is connected to intermediate segment 6 and the active wire to tip segment 5.

It should also be understood that in another not shown variation of the abovementioned embodiments the tip segment 5,105 may make its current contact through its tip 22,122 engaging a current contact member at end abutment 24,124 rather than with contact member 14 or 114.

Figure 9:
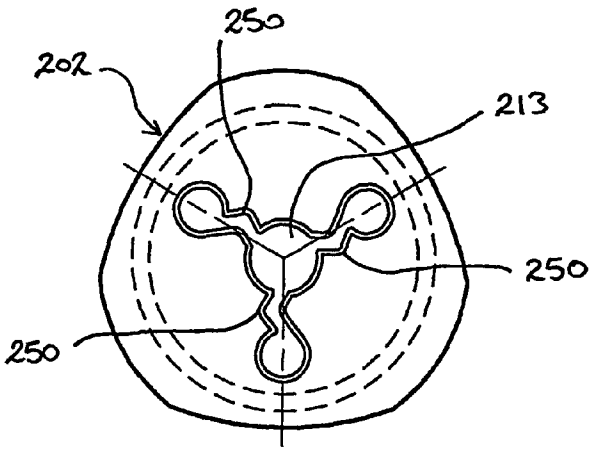
FIG. 9 is an end elevation of a socket in a third embodiment for use with a plug in accordance with the present invention.
Figure 7:
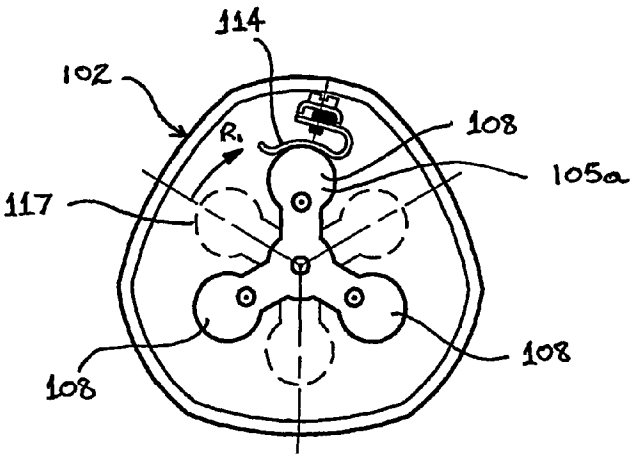
FIG. 7 is a schematic sectional view through VII—VII of the plug and socket shown in FIG. 6.
Figure 8:
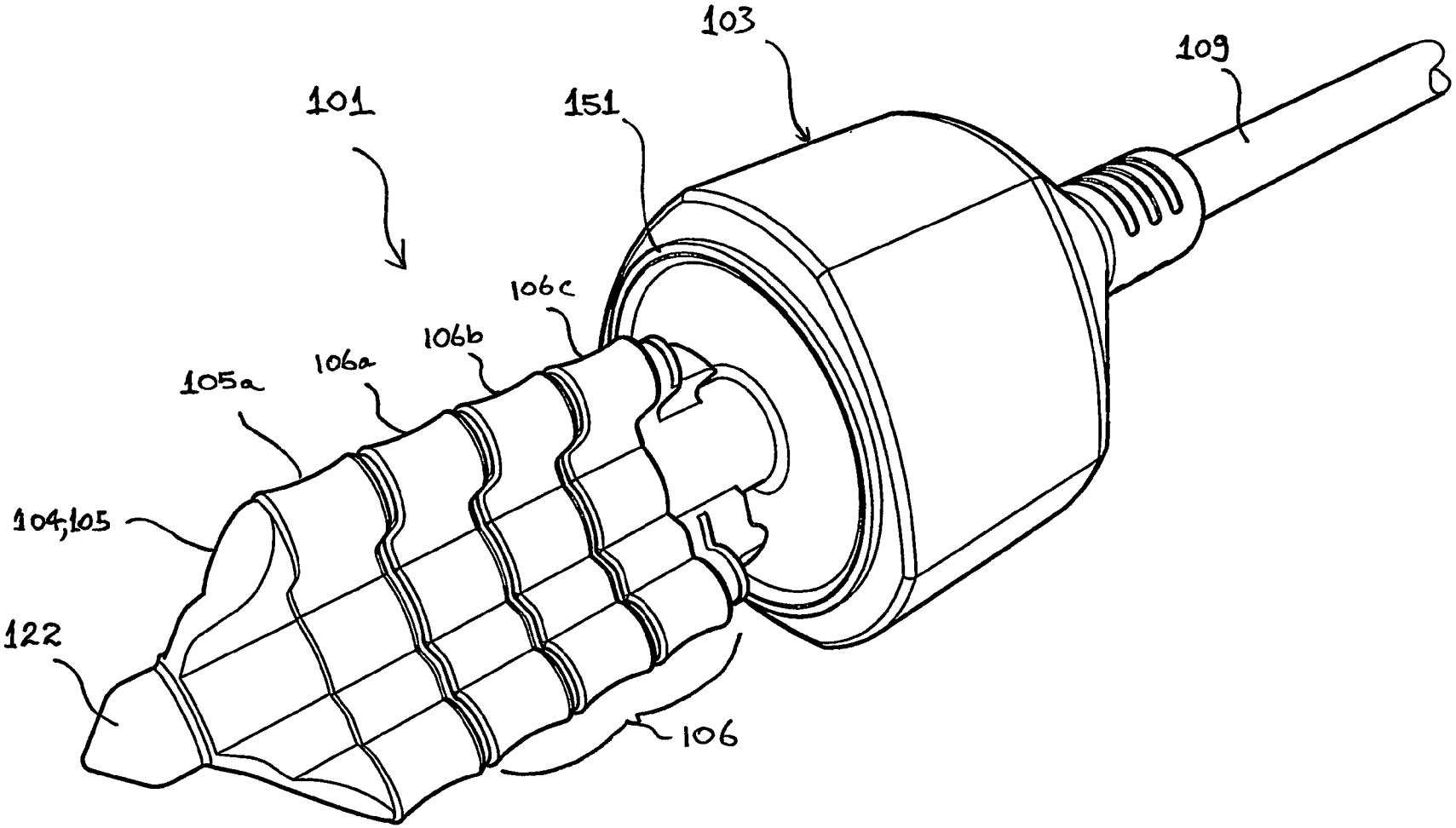
FIG. 8 is a perspective view of the plug shown in FIG. 5.

FIG. 9 depicts a third embodiment of a socket 202 for use with a third embodiment of an electrical plug and socket in accordance with the present invention. Like that of the first and second embodiments, the aperture 213 of socket 202, has a "tri-wing" configuration, as does the prong of the not shown plug. However, aperture 213 has three kinked portions 250. Each wing of the plug prong (not shown) would also have a complementary kinked portion such that it may be received by socket 202. The kinked portions 250 of each wing of aperture 213, make it difficult for children or others to insert a metallic object into socket 202, and make contact with a live terminal.

In another not shown embodiment the tri-wing configuration of the prong could be replaced by a bi-wing configuration, having two wings least two equally spaced apart wings, however the prong having similar spaced apart segments 5,6,7 or 105,106,107 as in the abovementioned embodiments. In such an embodiment, the plug would require insertion into a complementary socket prior to its rotation for electrical connection. In other not shown embodiments the prong may have four, five or more wings.

In further not shown embodiments the plug and socket profiles may differ from those shown in the abovementioned embodiments without departing from the scope of the present invention.

The term "comprising" (and its grammatical variations) as used herein is used in the inclusive sense of "having" or "including" and not in the exclusive sense of "consisting only of".

The invention claimed is:

1. An electrical plug comprising a prong extending from a body, said prong having a tip segment at its free end, a base segment at its other end and an intermediate segment therebetween, each segment being insulated from each other, said tip segment and said intermediate segment adapted for carrying current, said plug having wire connection means extending into said prong, said plug adapted to be inserted into a socket and then subsequently rotated such that at least a portion of said intermediate segment engages with a first current carrying contact member housed within said socket, and wherein said intermediate segment comprises at least two equally spaced apart wings each of which is adapted to carry current and at least one of said wings are adapted to contact said first current carrying contact member.

2. An electrical plug as claimed in claim 1, wherein the aperture of said socket is complementary shaped to receive said prong.

3. An electrical plug as claimed in claim 1, wherein said intermediate segment is adapted to carry the neutral current and said tip segment adapted to carry the active current.

4. An electrical plug as claimed in claim 1, wherein said socket comprises a clutch-release mechanism that allows said prong to rotate and disengage from said socket when sufficient force is applied to the plug in a direction substantially opposite to the entry of said prong.

5. An electrical plug as claimed in claim 1 wherein said at least two equally spaced apart wings each have a kinked portion thereon.

6. An electrical plug as claimed in claim 1, wherein said prong has a base member adapted to be connected to earth.

7. An electrical plug as claimed in claim 6, wherein said base member engages with an earth contact member that shrouds the aperture of said socket.

8. An electrical plug as claimed in claim 1, wherein said intermediate segment is adapted to carry the active current and said tip segment adapted to carry the neutral current.

9. An electrical plug as claimed in claim 8, wherein said socket comprises a clutch-release mechanism that allows said prong to rotate and disengage from said socket when sufficient force is applied to the plug in a direction substantially opposite to the entry of said prong.

10. An electrical plug as claimed in claim 1, wherein said tip segment engages with a second current carrying contact member housed within said socket.

11. An electrical plug as claimed in claim 10, wherein at least a portion of said tip member comprises at least two spaced apart wings each of which is adapted to carry current and at least one of said wings is adapted to contact said second current carrying contact member.

12. An electrical plug as claimed in claim 10, wherein said at least two equally spaced apart wings comprise three equally spaced apart wings.

13. An electrical plug as claimed in claim 10, wherein said socket comprises a clutch-release mechanism that allows said prong to rotate and disengage from said socket when sufficient force is applied to the plug in a direction substantially opposite to the entry of said prong.

14. An electrical plug as claimed in claim 1, wherein said at least two equally spaced apart wings comprise three equally spaced apart wings.

15. An electrical plug as claimed in claim 14, wherein at least a portion of said tip member comprises at least three spaced apart wings each of which is adapted to carry current and at least one of said wings are adapted to contact said second current carrying contact member.

16. An electrical plug as claimed in claim 14, wherein said intermediate segment has three separate current carrying portions, a first portion, a second portion and a third portion, each portion is insulated from each other and the first portion is adapted to engage with said first current carrying contact member.

17. An electrical plug as claimed in claim 14, wherein said prong has a base member adapted to be connected to earth.

* * * * *